United States Patent [19]

Ishida et al.

[11] Patent Number: 4,887,563

[45] Date of Patent: Dec. 19, 1989

[54] VALVE OPERATING APPARATUS FOR AN INTERNAL COMBUSTION ENGINE

[75] Inventors: Atsushi Ishida; Tsuneo Konno, both of Saitama, Japan

[73] Assignee: Honda Giken Kogyo Kabushiki Kaisha, Tokyo, Japan

[21] Appl. No.: 108,019

[22] Filed: Oct. 14, 1987

[30] Foreign Application Priority Data

Oct. 16, 1986 [JP] Japan ..... 61-246426
Oct. 17, 1986 [JP] Japan ..... 61-247137

[51] Int. Cl.[4] ..... F01L 1/26

[52] U.S. Cl. ..... 123/90.16; 123/90.17; 123/90.44

[58] Field of Search ..... 123/90.16, 90.17, 90.44, 123/198 F

[56] References Cited

U.S. PATENT DOCUMENTS

| | | | |
|---|---|---|---|
| 2,829,540 | 4/1958 | Niemeyer | 74/569 |
| 3,299,869 | 1/1967 | Sicklesteel | 123/90.27 |
| 3,722,484 | 3/1973 | Gordini | 123/90.27 |
| 4,151,817 | 5/1979 | Mueller | 123/90.16 |
| 4,203,397 | 5/1980 | Soeters, Jr. | 123/90.16 |
| 4,206,734 | 6/1980 | Perr et al. | 123/502 |
| 4,448,156 | 5/1984 | Henault | 123/90.17 |
| 4,499,870 | 2/1985 | Aoyama | 123/198 F |
| 4,523,550 | 6/1985 | Matsuura | 123/90.16 |
| 4,534,323 | 8/1985 | Kato et al. | 123/90.16 |
| 4,535,732 | 8/1985 | Nakano et al. | 123/90.16 |
| 4,537,164 | 8/1985 | Ajiki et al. | 123/90.16 |
| 4,537,165 | 8/1985 | Honda et al. | 123/90.16 |
| 4,545,342 | 10/1985 | Nakano et al. | 123/198 F |
| 4,567,861 | 2/1986 | Hara et al. | 123/90.16 |
| 4,576,128 | 3/1986 | Kenichi | 123/198 F |
| 4,584,974 | 4/1986 | Aoyama et al. | 123/90.16 |
| 4,589,387 | 5/1986 | Miura et al. | 123/198 F |
| 4,612,884 | 9/1986 | Ajiki et al. | 123/90.16 |
| 4,615,307 | 10/1986 | Kodama et al. | 123/90.16 |
| 4,656,977 | 4/1987 | Nagahiro et al. | 123/90.16 |
| 4,690,110 | 9/1987 | Nishimura et al. | 123/90.17 |
| 4,727,830 | 3/1988 | Nagahiro et al. | 123/90.16 |
| 4,727,831 | 3/1988 | Nagahiro et al. | 123/90.16 |
| 4,759,322 | 7/1988 | Konno | 123/90.16 |
| 4,765,289 | 8/1988 | Masuda et al. | 123/90.17 |

FOREIGN PATENT DOCUMENTS

| | | |
|---|---|---|
| 0186341 | 7/1986 | European Pat. Off. . |
| 0213758 | 3/1987 | European Pat. Off. . |
| 3613945 | 10/1986 | Fed. Rep. of Germany . |
| 1003568 | 3/1952 | France . |
| 61-19911 | 1/1986 | Japan . |
| 61-81510 | 4/1986 | Japan . |
| 511903 | 8/1939 | United Kingdom . |
| 1399813 | 7/1975 | United Kingdom . |
| 2054036 | 2/1981 | United Kingdom . |
| 2066361 | 7/1981 | United Kingdom . |
| 2141172 | 12/1984 | United Kingdom . |
| 2159877 | 12/1985 | United Kingdom . |
| 2185784 | 7/1987 | United Kingdom . |

*Primary Examiner*—Andrew M. Dolinar
*Attorney, Agent, or Firm*—Lyon & Lyon

[57] ABSTRACT

Apparatus for controlling the operation of intake or exhaust valves of an internal combustion engine in which cam-driven rocker arms that operate the valves are selectively connected or disconnected for movement in unision or for independent movement in order to open and close the valves in accordance with the various modes of engine operation. Control of the valves is produced by the cooperative effect of hydraulic pressure and variable spring forces whereby more accurate valve operation over a greater number of engine operating modes is achieved.

21 Claims, 7 Drawing Sheets

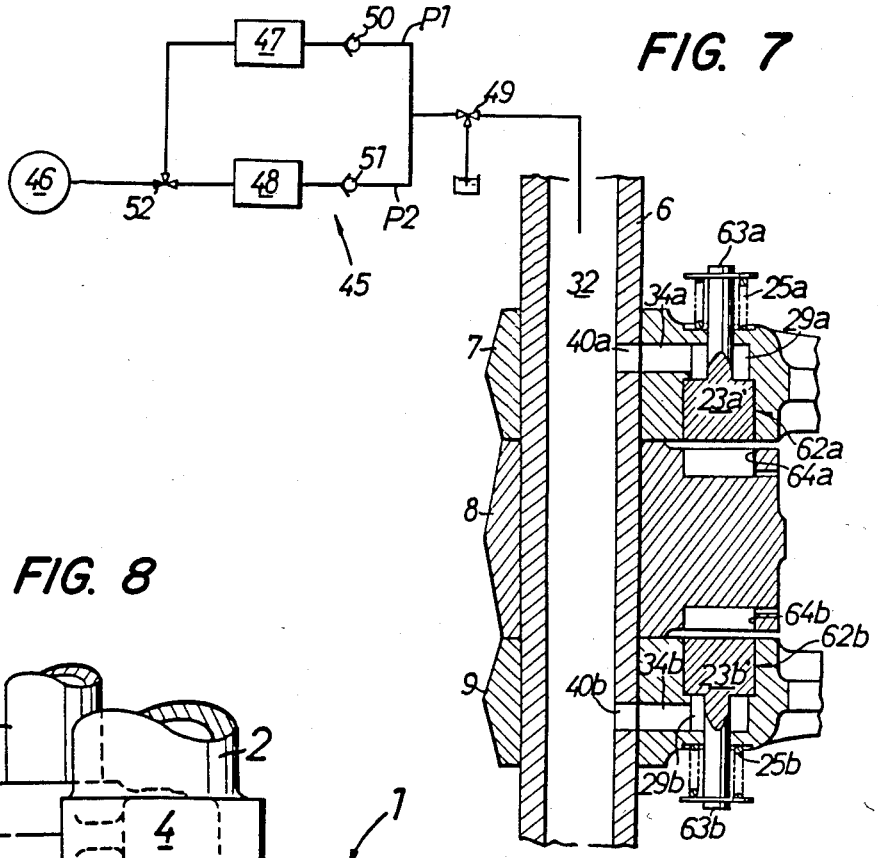
FIG. 7
FIG. 8
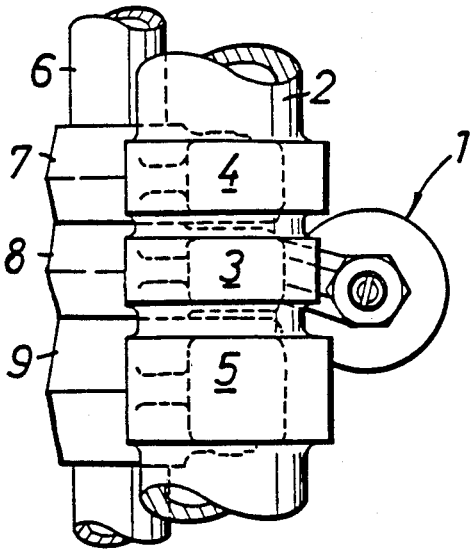
FIG. 9
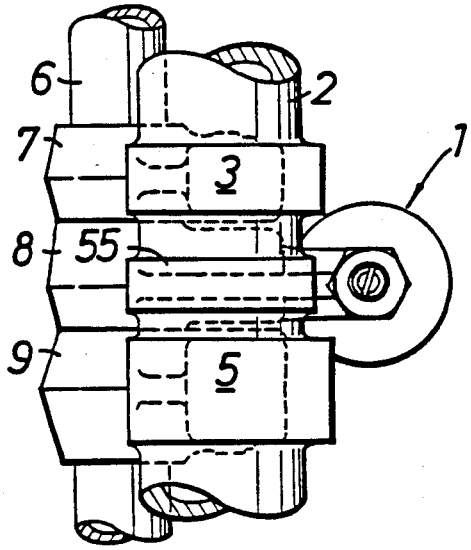

VALVE OPERATING APPARATUS FOR AN INTERNAL COMBUSTION ENGINE

BACKGROUND OF THE INVENTION

The present invention relates to apparatus for operating the intake or exhaust valves of an internal combustion engine. More particularly, the invention relates to such apparatus in which a plurality of adjacently positioned, pivotally mounted cam followers open and close the valves in response to the rotation of cams on a camshaft driven in synchronism with the operation of the engine and in which the respective cam followers are connected or disconnected for operation in unison or independently by selectively actuated, hydraulically operated couplings for imparting various modes of operation to the valves.

One such valve operating apparatus of the concerned type is shown and described in U.S. patent application Ser. No. 009,239, filed Jan. 30, 1987 and assigned to the assignee herein. In such apparatus the cam followers are pivotally mounted on a rocker shaft having a hollow interior defining the hydraulic pressure supply passage to the respective couplings. The hydraulic pressure is supplied independently to the hydraulic pressure chambers of the respective couplings to operate pistons therein in cooperation with return springs. In such prior art valve operating devices the return springs in the respective couplings have the same set load and, in order to provide independent hydraulic pressure supply passages to the respective hydraulic pressure chambers, it is necessary to force and fix a steel ball in the rocker arm shaft in order to divide its interior into independent passages communicating with the hydraulic pressure chambers of the respective couplings. This results in the need for a complex hydraulic pressure supply circuit.

It is to the amelioration of this problem that the present invention is directed.

SUMMARY OF THE INVENTION

According to the present invention the return springs are arranged such that different spring biasing forces are imposed on the couplings during various modes of selective operation and the hydraulic pressure supply passage defined by the interior of the rocker shaft is common to the hydraulic pressure chambers of all of the couplings. By means of the invention, the respective couplings are selectively operated by supplying the selected hydraulic pressures from a system in which it is not necessary to divide the hydraulic pressure supply passage into separate portions communicating each with respective of the selective couplings in order to operate the couplings independently. The result produced is a hydraulic pressure supply circuit of simple configuration.

It is accordingly an object of the present invention to provide a valve operating apparatus for an internal combustion engine permitting the use of a simple hydraulic pressure supply circuit.

It is a further object of the invention to provide a valve operating apparatus for an internal combustion engine employing a simple hydraulic pressure supply circuit capable of selectively operating valves in multiple modes of operation whereby the valve operation can be accurately controlled in the various modes of engine operation.

For a better understanding of the invention, its operating advantages and the specific objectives obtained by its use, reference should be made to the accompanying drawings and description which relate to several preferred embodiments thereof.

BRIEF DESCRIPTION OF THE DRAWINGS

FIGS. 5, 6 and 7 are views similar to FIG. 4, illustrating various embodiments of valve operating apparatus contemplated by the present invention;

FIGS. 8, 9 and 10 are plan views similar to FIG. 2 illustrating cam arrangements constituting further embodiments of the valve operating apparatus contemplated by the invention;

DESCRIPTION OF THE PREFERRED EMBODIMENTS OF THE INVENTION

Figure 1:
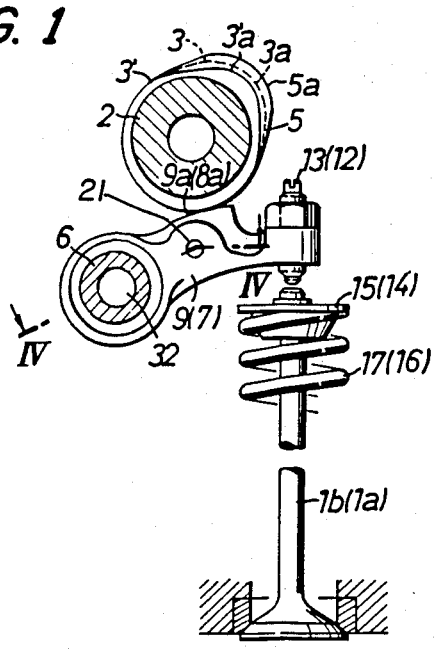
FIG. 1 is an elevational view, taken along line I—I of FIG. 2 and illustrating a valve operating apparatus according to the present invention.
Figure 2:
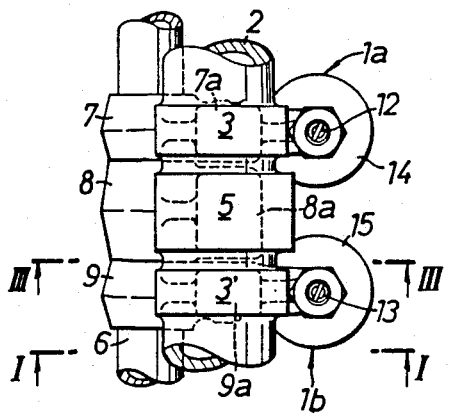
FIG. 2 is a plan view of the valve operating apparatus of FIG. 1.

FIGS. 1 and 2 illustrate a pair of intake valves 1*a*, 1*b* disposed in an engine body and capable of being opened and closed by a first low-speed cam 3, a high-speed cam 5, and a second low-speed cam 3' integrally formed on a camshaft 2. The camshaft 2 is rotatable in synchronism with rotation of the engine at a speed ratio of ½ with respect to the speed of rotation of the engine. The intake valves 1*a*, 1*b* are operated by the cams 3, 5 and 3' via first, second and third rocker arms 7, 8, 9 pivotally supported as cam followers on a rocker shaft 6 parallel to the camshaft 2 and driven by the respective cams.

The camshaft 2 is rotatably disposed above the engine body. The high-speed cam 5 is disposed on the camshaft 2 in alignment with a position between the intake valves 1*a*, 1*b*. The first and second low-speed cams 3, 3' are disposed on the camshaft 2, one on each side of the high-speed cam 5. The first low-speed cam 3 has circumferential profile corresponding to low-speed operation of the engine and has a cam lobe 3*a* projecting radially outwardly from the camshaft 2 to a relatively small extent. The high-speed cam 5 has a profile corresponding to high-speed operation of the engine. It has a cam lobe 5*a* projecting radially outwardly from the camshaft 2 to an extent larger than that of the cam lobe 3*a* of the first low-speed cam 3, It also has a larger angular extent than that of the cam lobe 3*a*. The second low-speed cam 3' also has a circumferential profile corresponding to low-speed operation of the engine and has a cam lobe 3'*a* projecting radially to an extent smaller than that of the cam lobe 3*a*.

The rocker shaft is fixed below the camshaft 2. The first rocker arm 7, the second rocker arm 8, and the third rocker arm 9 are pivotally supported on the rocker shaft 6 in alignment with the first low-speed cam 3, the high-speed cam 5, and the second low-speed cam 3', respectively. The rockers arms 7, 8, 9 are positioned in axially adjacent relation. The first and second rocker arms 7, 8, 9 have on their upper portions cam slippers 7*a*, 8*a*, 9*a* that are held in sliding contact with the cams 3, 5, 3', respectively. The first and second rocker arms 7, 9 extend to positions above the intake valves 1*a*, 1*b*, respectively. Tappet screws 12, 13 are threaded through the distal ends of the respective first and second rocker arms 7, 8 and are engageable respectively with the upper ends of the intake valves 1*a*, 1*b*.

Retainers 14, 15 are attached to the upper ends of the intake valves 1*a*, 1*b*. The intake valves 1*a*, 1*b* are normally urged in a closing direction, i.e., upwardly, by valve springs 16, 17 disposed between the retainers 14, 15 and the engine body.

Figure 3:
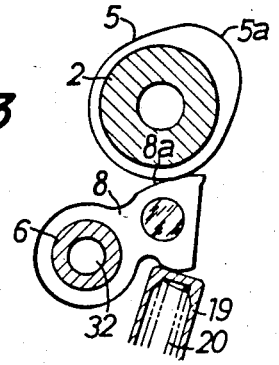
FIG. 3 is a sectional view taken along line III—III of FIG. 2.

As shown in FIG. 3, a cylindrical lifter 19 having a closed upper end is disposed in abutment against a lower surface of the distal end of the second rocker arm 8. The lifter 19 is normally urged upwardly by lifter spring 20 of a relatively weak spring force interposed between the lifter 19 and the engine body for normally holding the cam slipper 8*a* of the second rocker arm 8 resiliently in sliding contact with the high-speed cam 5.

Figure 4:
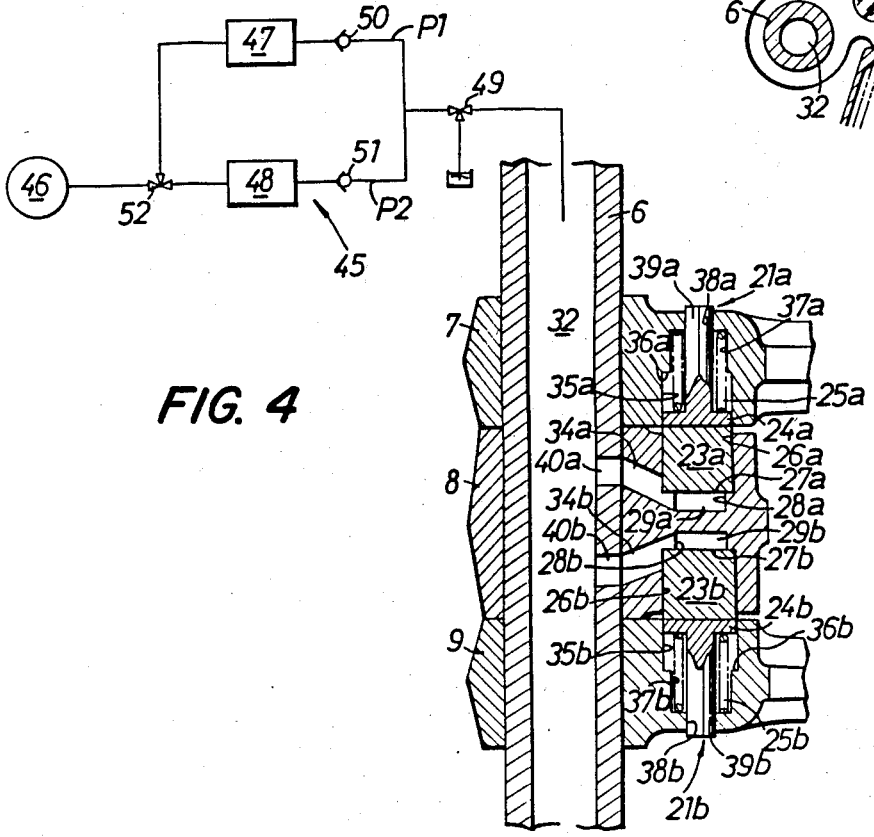
FIG. 4 is an enlarged sectional view taken along line IV—IV of FIG. 1 and containing a schematic representation of a hydraulic pressure supply circuit utilized with the valve operating apparatus.

As illustrated in FIG. 4, a first selective coupling 21*a* is disposed between the mutually adjacent first and second rocker arms 7, 8. The coupling 21*a* is operative to selectively disconnect the rocker arms 7, 8 thereby permitting their relative angular movement or to interconnect the rocker arms 7, 8 so that they undergo angular movement in unison. A second selective coupling 21*b* is disposed between the mutually adjacent second and third rocker arms 8, 9 for selectively disconnecting the rocker arms 8, 9 for relative angular movement and for interconnecting them for movement in unison.

The first and second selective couplings 21*a*, 21*b* are basically of the same construction. The first selective coupling 21*a* will hereinafter be described in detail with its components denoted by reference numerals with the suffix a. The second selective coupling 21*b* will not be described in detail, but is shown in the drawing with the component parts thereof denoted by reference numerals having a suffix b.

The first selective coupling 21*a* comprises a piston 23*a* as a coupling member movable between a position in which it interconnects the first and second rocker arms 7, 8 and a position in which it disconnects the first and second rocker arms. Also provided are a stopper 24*a* for limiting movement of the piston 23*a*, and a return spring 25*a* for urging the stopper 24*a* to move the piston 23 into the position to disconnect the rocker arms.

The second rocker arm 8 has a first guide hole 26*a* defined therein having its outer end closed and its inner end opening toward the first rocker arm 7. The guide hole 26*a* extends parallel to the rocker shaft 6. The second rocker arm 8 also has a smaller-diameter hole 28*a* defined in the closed end of the first guide hole 26*a* with a step 27*a* therebetween. The piston 23*a* is slidably fitted in the first guide hole 26*a*. A hydraulic pressure chamber 29*a* is defined between the piston 23*a* and the closed end of the hole 28*a*.

The first rocker arm 7 has a second guide hole 35*a* defined therein having its outer end closed and its inner end opening toward the second rocker arm for registration with the first guide hole 26*a*. The circular stopper 24*a* is slidably fitted in the second guide hole 35*a*. The first rocker arm 7 also has a smaller-diameter hole 37*a* defined in the closed end of the second guide hole 35*a* with a step 36*a* therebetween, and a hole 38*a* in the closed end of the hole 37*a* in coaxial relation to the hole 37*a*. A guide rod 39*a* coaxially disposed on the stopper 24*a* extends through the hole 38*a*. A return coil spring 25*a* is disposed around the guide rod 39*a* between the stopper 24*a* and the closed end of the smaller-diameter hole 37*a*.

The piston 23*a* has an axial length selected such that, when one end thereof abuts against the step 27*a*, the other end of the piston 23*a* is positioned at the interface between the first and second rocker arms 7, 8, and, when the stopper 24*a* enters the second guide hole 35*a* until it engages the step 36*a*, the said one end of the piston 23*a* remains in the first guide hole 26*a*.

The second rocker arm 8 has a hydraulic passage 34*a* disposed in communication with the hydraulic pressure chamber 29*a*. The rocker shaft 6 has a passage 40*a* through which the hydraulic passage 34*a* is maintained in communication with a hydraulic pressure supply passage 32 in the rocker shaft 6, irrespective of how the second rocker arm 8 is angularly moved.

In the first selective coupling 21*a* a hydraulic pressure, which is sufficiently high to move the piston 23*a* against the spring force of the return spring 25*a* is supplied from the hydraulic pressure supply passage 32 to the hydraulic pressure chamber 29*a* thereby causing the piston 23*a* to interconnect the first and second rocker arms 7, 8.

In the second selective coupling 21*b* a hydraulic pressure, which is sufficiently high to move the piston 23*b* against the spring force of the return spring 25*b* is supplied from the hydraulic pressure supply passage 32 to the hydraulic pressure chamber 29*b* thereby causing the piston 23*b* to interconnect the second and third rocker arms 8, 9.

In the described arrangement the return springs 25*a*, 25*b* of the first and second selective couplings 21*a*, 21*b* are of different set loads from each other. For example, the set load of the return spring 25*a* is selected to be smaller than the set load of the return spring 25*b*.

The hydraulic pressure supply passage 32 is connected to a hydraulic pressure supply means 45. The hydraulic pressure supply means 45 comprises a hydraulic pressure supply source 46, two parallel regulators 47, 48 connected to the hydraulic pressure supply source 46 through a changeover valve 52, and a control valve 49 operable in one mode for selectively supplying hydraulic pressure from the regulators 47, 48 to the hydraulic passage 32, and in another mode for releasing hydraulic pressure from the hydraulic passage 32. Check valves 50, 51 are disposed between the regulators 47, 48 and the control valve 49.

The regulator 47 produces a relatively low hydraulic pressure P1 from the hydraulic pressure generated by the hydraulic pressure supply source 46. The hydraulic pressure P1 is of such value as to produce a hydraulic force to move the piston 23*a* against the spring force of the return spring 25*a* when supplied to the hydraulic pressure chamber 29*a* of the first selective coupling 21*a*, but less than the spring force of the return spring 25*b*, when supplied to the hydraulic pressure chamber 29 of the second selective coupling 21*b*. The other regulator 48 produces a relatively high hydraulic pressure P2 from the hydraulic pressure generated by the hydraulic pressure supply source 46. Accordingly, when the hydraulic pressure P2 is supplied to the hydraulic pressure chambers 29*a*, 29*b*, it produces a hydraulic force sufficient to move both pistons 23*a*, 23*b* against the spring forces of their respective return springs 25*a*, 25*b*.

Operation of the described arrangement is as follows. During low-speed operation of the engine, the control valve 49 is operated to release hydraulic pressure from the hydraulic passage 32, i.e., from the hydraulic pressure chambers 29*a*, 29*b*. Therefore, the pistons 23*a*, 23*b* of the first and second selective couplings 21*a*, 21*b* are urged into the hydraulic pressure chambers 29*a*, 29*b* under the bias of the return springs 25*a*, 25*b*. Thus, the first, second, and third rocker arms 7, 8, 9 are disconnected from one another, and are thus angularly movable relatively to each other while holding the engaged end surfaces of the pistons 23*a*, 23*b* and the stoppers 24*a*, 24*b* in mutually sliding contact.

With the rocker arms disconnected by the selective couplings 21*a*, 21*b*, the first rocker arm 7 is angularly moved in sliding contact with the first low-speed cam 3 upon rotation of the camshaft 2, and the third rocker arm 9 is angularly moved in sliding contact with the second low-speed cam 3'. At this time, angular movement of the second rocker arm 8 in sliding contact with the high-speed cam 5 does not affect the operation of the first and third rocker arms 7, 9.

While the engine is operating at low speed, therefore, the intake valve 1*a* is opened and closed at the valve timing and lift according to the cam profile of the first low-speed cam 3, and the intake valve 1*b* is opened and closed at the valve timing and lift according to the cam profile of the second low-speed cam 3'. Therefore, air-fuel mixture is admitted at a velocity suitable for the low-speed operation of the engine, allowing stable fuel combustion for improved fuel economy, stable low-speed operation, and knock prevention. Since the cam profiles of the low-speed cams 3, 3' are different, the air-fuel mixture in the combustion chamber undergoes a high degree of turbulence thereby resulting in higher fuel economy.

During medium-speed operation of the engine, relatively low hydraulic pressure P1 is supplied by the hydraulic pressure supply means 45 to the hydraulic pressure chambers 29*a*, 29*b*. In the first coupling 21*a*, the piston 23*a* is moved into the first rocker arm 7 against the bias of the return spring 25*a* thereby interconnecting the first and second rocker arms 7, 8. The first and second rocker arms 7, 8 are thus caused to be angularly moved by the high-speed cam 5. In the second coupling 21*b*, the piston 23*b* is prevented by the return spring 25*b* from moving, so that the second and third rocker arms 8, 9 remain disconnected.

Consequently, while the engine is operating at a medium speed, the intake valve 1*a* is opened and closed at the valve timing and lift according to the cam profile of the high-speed cam 5, and the intake valve 1*b* is opened and closed at the valve timing and lift according to the cam profile of the second low-speed cam 3'.

During high-speed operation of the engine, relatively high hydraulic pressure P2 is supplied by the hydraulic pressure supply means 45 to the hydraulic pressure chambers 29*a*, 29*b*. In the second coupling 21*b*, the piston 23*b* is moved into the third rocker arm 9 against the bias of the return spring 25*b*, thereby interconnecting the second and third rocker arms 8, 9. Since the pressure P2 is sufficiently high to move the piston 23*a* against the bias of the return spring 25*a*, the first and second rocker arms 7, 8 remain interconnected. Thus, in this mode of operation, the first, second and third rocker arms 7, 8, 9 are angularly moved in unison by the high-speed cam 5. The intake valves 1*a*, 1*b* are, therefore, opened and closed at the valve timing and lift according to the cam profile of the high-speed cam 5.

In the valve operating device thus constructed, the hydraulic pressure supply passage 32 in the rocker shaft 6 is common to the couplings 21*a*, 21*b*, and the hydraulic pressure applied is supplied in one axial direction of the rocker shaft 6. The hydraulic pressure supply circuit employed with the arrangement is therefore not complex, even when incorporated in a multicylinder internal combustion engine.

Figure 5:
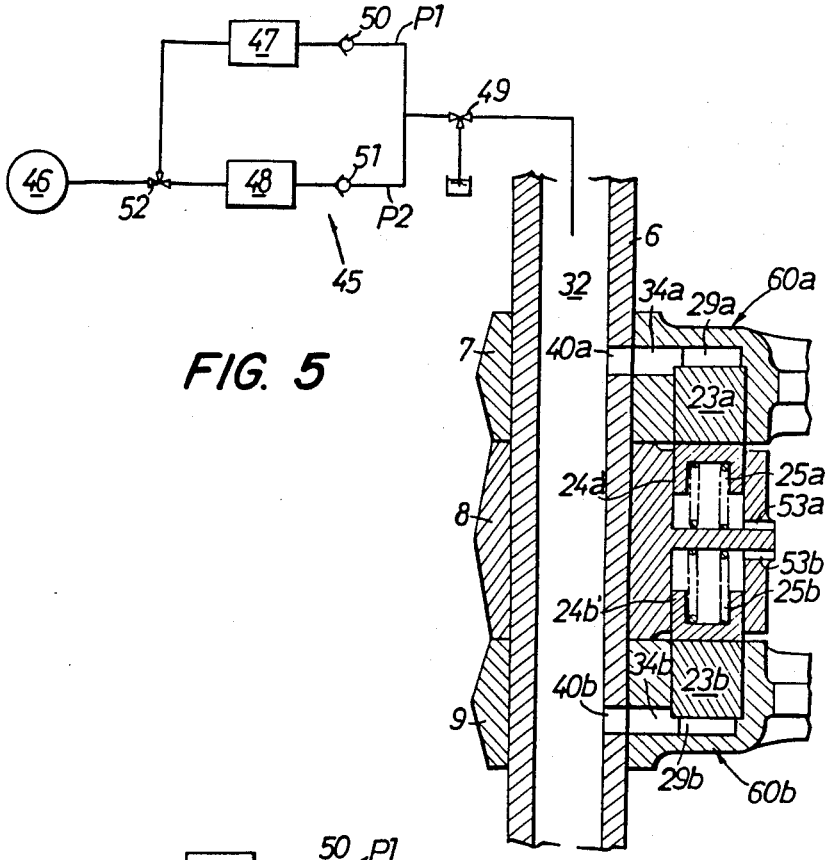

FIG. 5 shows a second embodiment of the present invention in which those parts that correspond to the parts of the first embodiment are denoted by identical reference numerals. In this embodiment pistons 23*a*, 23*b* of first and second selective couplings 60*a*, 60*b* are slidably fitted in first and third rocker arms 7, 9, and stoppers 24*a*, 24*b* are slidably fitted in a second rocker arm 8. Return springs 25*a*, 25*b* are disposed between the second rocker arm 8 and the stoppers 24*a'*, 24*b'*. The second rocker arm 8 has air vent holes 53*a*, 53*b* to permit the stoppers 24*a'*, 24*b'* to move smoothly. A hydraulic pressure chamber 29*a* is defined between the first rocker arm 7 and the piston 23*a*, and a hydraulic pressure chamber 29*a* is defined between the third rocker arm 9 and the piston 23*b*. The hydraulic pressure supply passage 32 is held in communication with the hydraulic pressure chambers 29*a*, 29*b*. The second embodiment also has the same advantages as those of the first embodiment.

Figure 6:
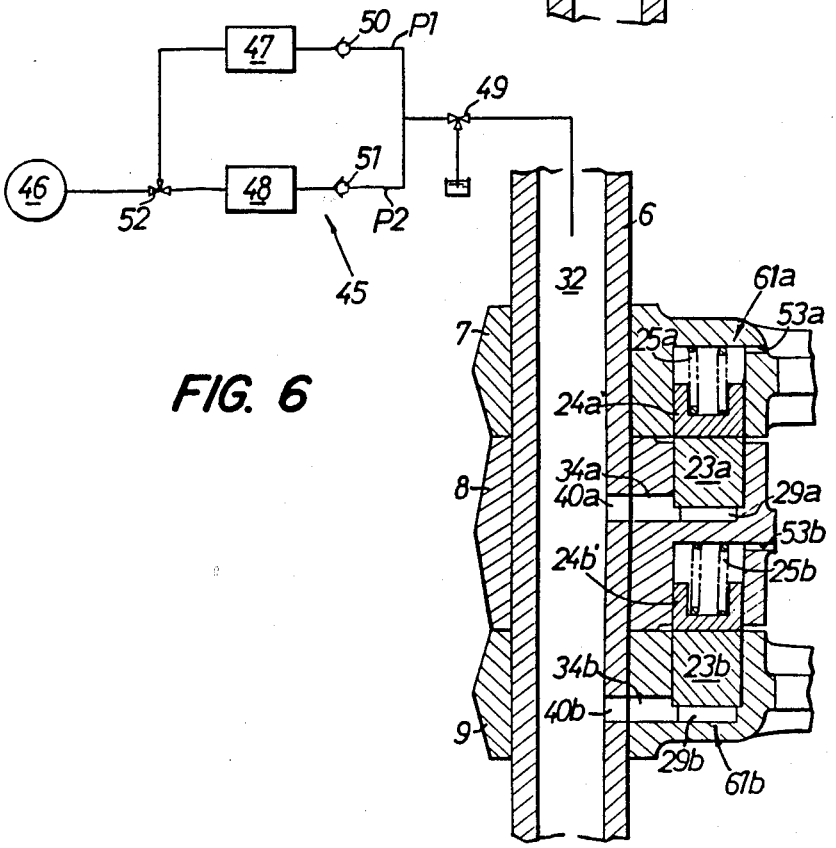

FIG. 6 shows a third embodiment of the present invention in which those parts which correspond to the parts of the previous embodiments are denoted by identical reference numerals. In this embodiment the piston 23*a* of a first selective coupling 61*a* and the stopper 24*b'* of a second selective coupling 61*b* are slidably fitted in the second rocker arm 8. The stopper 24*a'* of the first coupling 61*a* is slidably fitted in the first rocker arm 7. The piston 23*b* of the second coupling 61*b* is slidably fitted in the third rocker arm 9. This embodiment also has the same advantages as those of the previous embodiments.

FIG. 7 illustrates a fourth embodiment of the present invention. In this embodiment the piston 23*a'* of the first selective coupling 62*a* is slidably fitted in the first rocker arm 7. The piston 23*b'* of the second selective coupling 62*b* is slidably fitted in the third rocker arm 9. The second rocker arm 8 has guide holes 64*a*, 64*b* in which the pistons 23*a'*, 23*b'* are slidably fitted. Hydraulic pressure chambers 29*a*, 29*b* are defined between the first and third rocker arms 7, 9 and the pistons 23*a*, 23*b*, and are commonly connected to the hydraulic pressure supply passage 32 via passages 34*a*, 34*b* and holes 40*a*, 40*b*. The pistons 23*a*', 23*b*' have integral shafts 63*a*, 63*b* projecting out of the rocker arms 7, 9. Return springs 25*a*, 25*b* are interposed between the distal ends of the shafts 63*a*, 63*b* and the rocker arms 7, 9. This embodiment has the same advantages as those of the previous embodiments and the further advantage that it does not require the separate stopper members which have been required in the previous embodiments.

In the embodiment of the invention illustrated in FIG. 8, first, second and third rocker arms 7, 8, 9 are held in sliding contact with medium-, low-, and high-speed cams 4, 3, 5, respectively. A single intake valve 1 is operatively connected to the second rocker arm 8. The first and second rocker arms 7, 8, and the second and third rocker arms 8, 9 can selectively be interconnected and disconnected as previously described. In this embodiment, during low-speed operation of the engine, the rocker arms 7, 8, 9 are disconnected, and the intake valve 1 is opened and closed by the low-speed cam 3. While the engine is operating at a medium speed, the first and second rocker arms 7, 8 are interconnected, and the intake valve 1 is opened and closed by the medium-speed cam 4. During high-speed operation of the engine, the rocker arms 7, 8, 9 are all interconnected, and the intake valve 1 is opened and closed by the high-speed cam 5.

FIG. 9 illustrates a sixth embodiment of the present invention in which the first rocker arm 7 is held in sliding contact with a low-speed cam 3; the second rocker arm 8 is operatively coupled to a single intake valve 1 and held in sliding contact with a circular raised portion 55 on a camshaft 2; and the third rocker arm 9 is held in sliding contact with a high-speed cam 5. When the rocker arms 7, 8, 9 are disconnected, the intake valve 1 is caused to remain closed. This arrangement is effective for use in disabling a selected cylinder of a multicylinder internal combustion engine.

While several valve operating devices for driving intake valves have been described herein, it will be appreciated that the present invention is equally applicable to a valve operating device for driving exhaust valves. Moreover, three selective couplings may be disposed between four cam followers and three different hydraulic pressures selectively supplied to the respective couplings for more accurate valve operation control.

Figure 11:
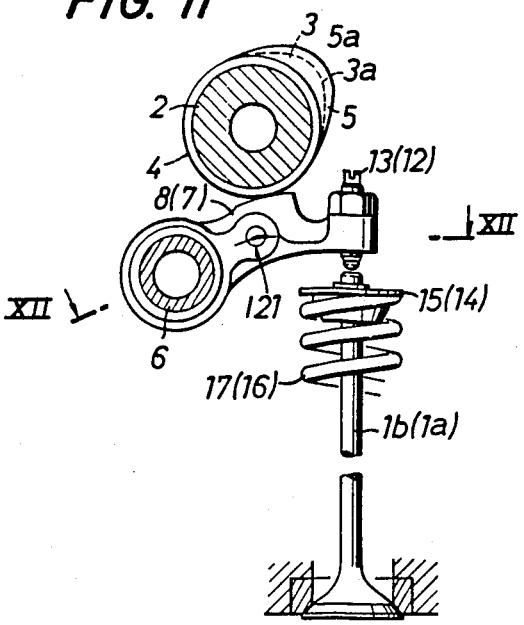
FIG. 11 is an elevational view taken along line XI—XI of FIG. 10.
Figure 10:
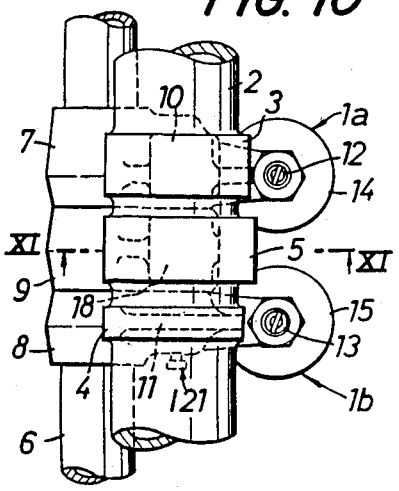

The valve operating apparatus according to the present invention is adapted to accommodate various other modes of valve operation. As shown in FIGS. 10 and 11, for example, the second low-speed cam 3' of FIGS. 1 and 2 can be replaced by a circular cam 4 such that intake valve 1*b* is caused to remain closed when rocker arm 9 is disconnected from rocker arm 8 and operated by its sliding contact with the circular cam 4.

Figure 12:
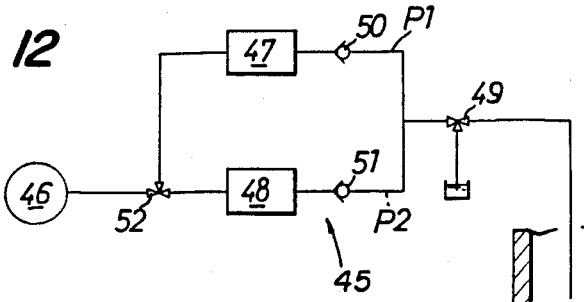
FIG. 12 is an enlarged sectional view taken along line XII—XII of FIG. 11 and containing a schematic representation of the hydraulic pressure supply circuit.

Additionally, other forms of selective coupling configurations can be employed. For example, as shown in FIGS. 10, 11 and 12, the selective coupling indicated as 121 disposed between the rocker arms 7 through 9 is arranged for admission of hydraulic pressure to a single hydraulic pressure chamber in the coupling. In this embodiment of the invention the selective coupling 121 comprises a first coupling pin 122 as a coupling member capable of interconnecting the first and third rocker arms 7, 9, a second coupling pin 123 as a coupling member capable of interconnecting third and second rocker arms 9, 8 and held coaxially against the first coupling pin 122. Also provided is the a stopper 124 for limiting movement of the coupling pins 122, 123, and springs 124, 125 for urging the coupling pins 122, 123 in a direction to disconnect the rocker arms. A hydraulic pressure supply means 45 similar to that employed in the previously described embodiment is used for supplying hydraulic pressure to operate the coupling pins 122, 123.

The first rocker arm 7 has a first guide hole 129 opening toward the third rocker arm 9 and extending parallel to the rocker shaft 6. The first coupling pin 122 is slidably fitted in the first guide hole 129. A hydraulic pressure chamber 130 is defined between the closed end of the first guide hole 129 and the first coupling pin 122. The first rocker arm 7 has a hydraulic passage 131 defined therein in communication with the hydraulic pressure chamber 130. The rocker shaft 6 has a hydraulic passage 132 coupled to the hydraulic pressure supply means 127. The hydraulic passages 131, 131 are held in communication with each other through a hole 133 defined in the side wall of the rocker shaft 6, irrespective of how the first rocker arm 7 is angularly moved about the rocker shaft 6.

The first coupling pin 122 includes a larger-diameter portion 134 slidably fitted in the first guide hole 129 and a smaller-diameter portion 135 coaxially and integrally joined to the end of the larger-diameter portion 134 adjacent the second coupling pin 123. The first coupling pin has a coaxial abutting projection 136 on its end facing the hydraulic pressure chamber 130, the abutting projection 136 being capable of engaging the closed end of the first guide hole 129. The first coupling pin 122 has an axial length selected such that, when the abutting projection 136 abuts against the closed end of the first guide hole 129, the end face of the smaller-diameter portion 135 is positioned between the first and third rocker arms 7, 9. The diameter of the smaller-diameter portion 135 is selected such that when the smaller-diameter portion 135 projects into the third rocker arm 9, swinging movement of the first rocker arm 7 by the low-speed cam 3 and swinging movement of the third rocker arm 9 by the high-speed cam 5 are permitted.

The third rocker arm 9 has a guide hole 137 extending between its opposite surfaces for registration with the first guide hole 129. The second coupling pin 123, having a length equal to the entire length of the guide hole 137, is slidably fitted therein. The second coupling pin 123 has an outside diameter equal to the outside diameter of the larger-diameter portion 134 of the first coupling pin 132.

The second rocker arm 8 has a guide hole 138 opening toward the third rocker arm 9 for registration with the guide hole 137, and a hole 139 larger in diameter than the guide hole 138 and formed coaxially therewith. An outwardly directed step 140 is present between the guide hole 138 and the larger-diameter hole 139. A circular stopper 124 having the same outside diameter as that of the second coupling pin 123 is slidably fitted in the guide hole 138. A shaft 141 is coaxially joined to the stopper 134. A retaining ring 142 is fitted in an inner surface of the larger-diameter hole 139 near its outer end. A cup-shaped, cylindrical limit member 143 is fitted in the larger-diameter hole 139. The limit member 143 is prevented by the retaining ring 142 from moving out of the larger-diameter hole 139. The limit member 143 has a guide hole 144 through which the shaft 141 of the stopper 124 extends. A ring-shaped seat plate 145 is movably fitted in the larger-diameter hole 139 so as to be engageable with the step 140 and the axially outer end surface of the stopper 124.

A first spring 125 is disposed between the limit member 143 and the stopper 124, and a second spring 126, concentric with the first spring 125, is disposed between the limit member 143 and the seat plate 145. When the coupling 121 is deactuated and the stopper 124 is in a position such that the first and second coupling pins 122, 123 are not operated to interconnect the rocker arms, the stopper 124 and the first and second coupling pins 122, 123 are urged only by the spring 125 to move toward the hydraulic pressure chamber 30. When the coupling 121 is actuated, however, and the stopper 124 has been moved axially to engage the seat plate 145, the spring forces of both of the springs 125, 126 act on the stopper 124 and the first and second coupling pins 122, 123. Therefore, the spring force acting on the stopper 124 and the first and second coupling pins 122, 123 toward the hydraulic pressure chamber 130 varies in two stages as the stopper 124 is urged by hydraulic pressure into engagement with the seat plate 145.

The hydraulic pressure supply means 45, as previously described, comprises a hydraulic pressure supply source 46, two parallel regulators 47, 48 coupled to the hydraulic pressure supply source 46 through a changeover valve 52, and a control valve 49 operable in one mode for selectively supplying hydraulic pressure from the regulators 47, 48 to the hydraulic passage 32 and in another mode for releasing hydraulic pressure from the hydraulic passage 32. Check valves 50, 51 are disposed between the regulators 47, 48 and the control valve 49.

Figure 13:
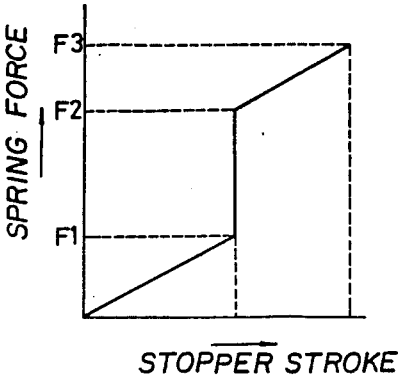
FIG. 13 is a graph illustrating various spring characteristics.
Figure 13:
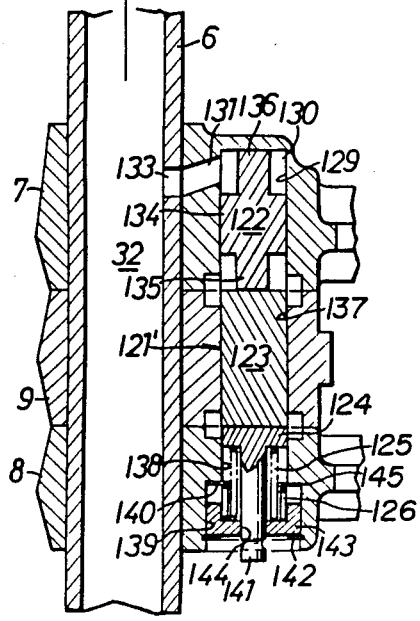

The regulator 47 produces a relatively low hydraulic pressure P1 from the hydraulic pressure generated by the hydraulic pressure supply source 46. The hydraulic pressure P1 is of such value as to produce a hydraulic force to move the coupling pins 122, 123 and the stopper 124 toward and into the second rocker arm 8 against the spring force F1 (FIG. 13). The hydraulic force is selected to be smaller than the spring force F2 in FIG. 13. More specifically, when the hydraulic pressure P1 acts in the hydraulic pressure chamber 130, the stopper 124 is moved until it engages the seat plate 145. At this time, the first coupling pin 122 is moved to the extent that only its smaller-diameter portion 135 projects into the guide hole 137. The other regulator 48 produces a relatively high hydraulic pressure P2 from the hydraulic pressure generated by the hydraulic pressure supply source 46. When the hydraulic pressure P2 is supplied to the hydraulic pressure chamber 130, it produces a hydraulic force greater than the spring force F3 (FIG. 13). Therefore, by applying the hydraulic pressure P2 to the hydraulic pressure chamber 130, there is generated a hydraulic force for moving the coupling pins 122, 123 and the stopper 124 against the combined spring force of the two springs 124, 125.

The operation of this embodiment of the invention is as follows. During low-speed operation of the engine, the control valve 49 releases hydraulic pressure from the hydraulic pressure chamber 130 through the hydraulic passages 131, 132. Therefore, the first and second coupling pins 122, 123 and the stopper 124 are displaced a maximum stroke toward the hydraulic pressure chamber 130 under the bias of the spring 125. In this condition, the abutting surfaces of the first and second coupling pins 122, 123 are positioned in alignment with the slidingly contacting surfaces of the first and third rocker arms 7, 9, and the abutting surfaces of the second coupling pin 123 and the stopper 124 are positioned in alignment with the slidingly contacting surfaces of the third and second rocker arms 9, 8. Therefore, the first through third rocker arms 7 through 9 are allowed to slide with respect to each other for relative angular displacement while maintaining the first and second coupling pins 122, 123 and the second coupling pin 123 and the stopper 124 in sliding contact with each other.

With the rocker arms thus disconnected by the selective coupling 121, the first rocker arm 7 is angularly moved in sliding contact with the low-speed cam 3 upon rotation of the camshaft 2 so that the intake valve **1*a* is opened and closed at the valve timing and lift according to the cam profile of the low-speed cam 3. The second rocker arm 8 is not angularly moved since the cam 4 has a circular profile. At this time, angular movement of the third rocker arm 9 in sliding contact with the high-speed cam 5 does not affect the operation of the intake valves 1*a*, 1*b***.

While the engine is operating at a low speed, therefore, only one of the intake valves **1*a*** is alternately opened and closed for reduced fuel consumption and improved engine idling characteristics.

Figure 14:
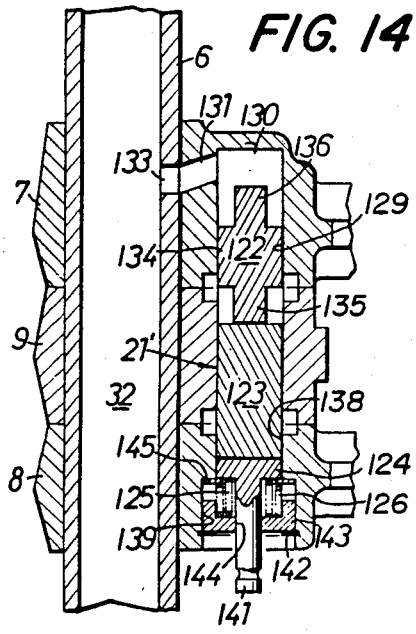
FIG. 14 is a sectional view illustrating the valve operating apparatus of FIGS. 10 through 12 with the coupling part shown during medium speed operation of the engine.

During medium-speed operation of the engine, the regulator 47 is actuated and relatively low hydraulic pressure P1 is supplied by the hydraulic pressure supply means 45 to the hydraulic pressure chamber 130. The stopper 124 is now moved axially into engagement with the seat plate 145 against the spring force of the spring 125 as shown in FIG. 14. The first coupling pin 122 is thus moved such that its smaller-diameter portion 135, but not its larger-diameter portion 134, projects into the guide hole 137 of the third rocker arm 9. The second coupling pin 123 is moved concomitantly such that it extends part way into the guide hole 138 of the second rocker arm 8. Therefore, the third and second rocker arms 9, 8 are interconnected by the second coupling pin 123, but the first and third rocker arms 7, 9 are capable of relative angular movement. Consequently, the intake valve **1*a* is alternately opened and closed at the valve timing and lift according to the cam profile of the low-speed cam 3, whereas the intake valve 1*b* is alternately opened and closed at the valve timing and lift according to the cam profile of the high-speed cam 5**.

Figure 15:
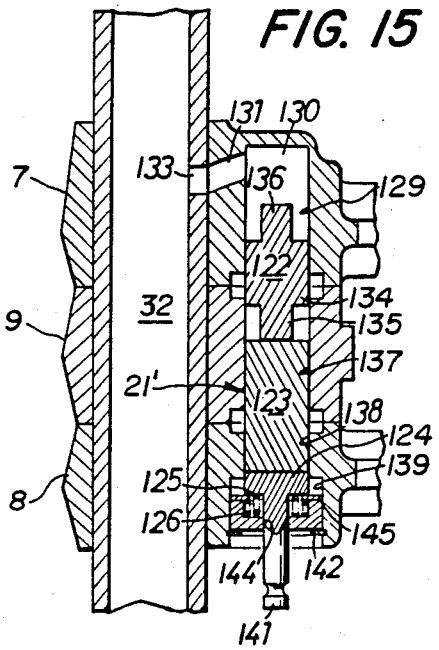
FIG. 15 is a sectional view similar to FIG. 14 illustrating the coupling parts during high speed operation of the engine.

During high-speed operation of the engine, the regulator 48 is operated such that relatively high hydraulic pressure P2 is supplied by the hydraulic pressure supply means 45 to the hydraulic pressure chamber 130. The first coupling pin 122 is thus moved against the combined spring forces of both of the springs 125, 126 until the larger-diameter portion 134 of the coupling pin 122 is slid into the guide hole 138 of the third rocker arm 9 as shown in FIG. 15, whereupon the first through third rocker arms 7 through 9, are interconnected. In this condition, the first and second rocker arms 7, 8 swing in unison with the third rocker arm 9 since the amount of angular movement of the third rocker arm 9 held in sliding contact with the high-speed cam 5 is greatest. The intake valves **1*a*, 1*b* are thus alternately opened and closed at the valve timing and lift according to the cam profile of the high-speed cam 5**.

Figure 18:
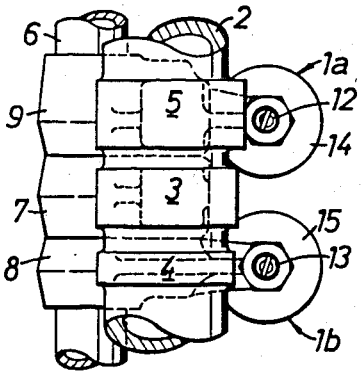
FIGS. 16, 17 and 18 are plan views similar to FIG. 2 illustrating cam arrangements operable with the present invention.
Figure 16:
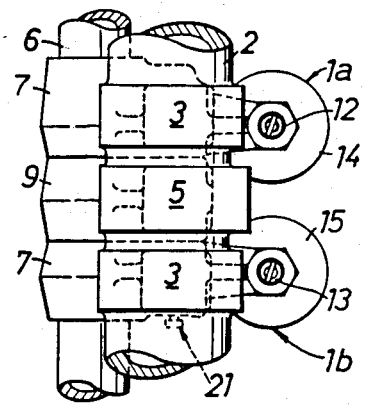
Figure 17:
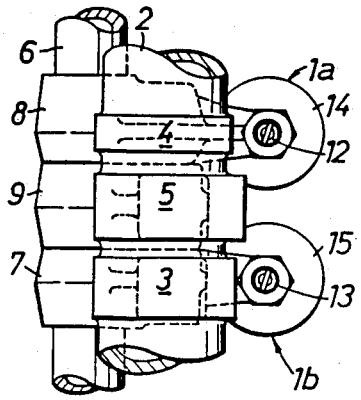

FIGS. 16, 17 and 18 illustrate modifications of the valve operating apparatus in which the low-speed cam 3, the cam 4 having a circular raised portion, and the high-speed cam 5 are disposed in different positions. In FIG. 16, two low-speed cams 3, 3 are disposed one on each side of a high-speed cam 5, and rocker arm 9 is held in sliding contact with the high-speed cam 5. Intake valves **1*a*, 1*b* engage rocker arms 7, 7 held in sliding contact with the low-speed cams 3, 3**, respectively.

During low-speed operation of the engine, the intake valves 1*a*, 1*b* are opened and closed at the valve timing and lift according to the cam profile of the low-speed cams 3, 3. While the engine is operating at medium speed, the intake valve 1*a* is opened and closed at the valve timing and lift according to the cam profile of the low-speed cam 3, whereas the intake valve 1*b* is opened and closed at the valve timing and lift according to the cam profile of the high-speed cam 5. During high-speed operation of the engine, the intake valves 1*a*, 1*b* are thus opened and closed at the valve timing and lift according to the cam profile of the high-speed cam 5.

According to a modification shown in FIG. 17, the cam having the circular raised portion 4 is disposed on one side of a high-speed cam 5, and a low-speed cam 3 is disposed on the opposite side of the high-speed cam 5. The rocker arm 8, held in sliding contact with the circular raised portion 4, engages one of the intake valves 1*a*, and rocker arm 7, held in sliding contact with the low-speed cam 3, engages the other intake valve 1*b*. Thus, during low-speed operation of the engine, the intake valve 1*a* remains closed, and the intake valve 1*b* is opened and closed at the valve timing and lift according to the cam profile of the low-speed cam 3. During medium-speed operation, the intake valve 1*a* remains closed, and the intake valve 1*b* is opened and closed at the valve timing and lift according to the cam profile of the high-speed cam 5. During high-speed operation, the intake valves 1*a*, 1*b* are opened and closed at the valve timing and lift according to the cam profile of the high-speed cam 5.

In FIG. 18, the high-speed cam 5 is located on one side of the low-speed cam 3, and the circular raised portion of cam 4 is located on the opposite side of the low-speed cam 3. Rocker arm 9, held in sliding contact with the high-speed cam 5, engages the intake valve 1*a*, and rocker arm 8, held in sliding contact with the cam 4, engages the other intake valve 1*b*. Thus, during low-speed operation of the engine, the intake valve 1*a* is opened and closed at the valve timing and lift according to the cam profile of the high-speed cam 5, and the intake valve 1*b* remains closed.

During medium-speed operation, the intake valve 1*a* is opened and closed at the valve timing and lift according to the cam profile of the high-speed cam 5, and the intake valve 1*b* is opened and closed at the valve timing and lift according to the cam profile of the low-speed cam 3. During high-speed operation, therefore, the intake valves 1*a*, 1*b* are opened and closed at the valve timing and lift according to the cam profile of the high-speed cam 5.

Figure 19:
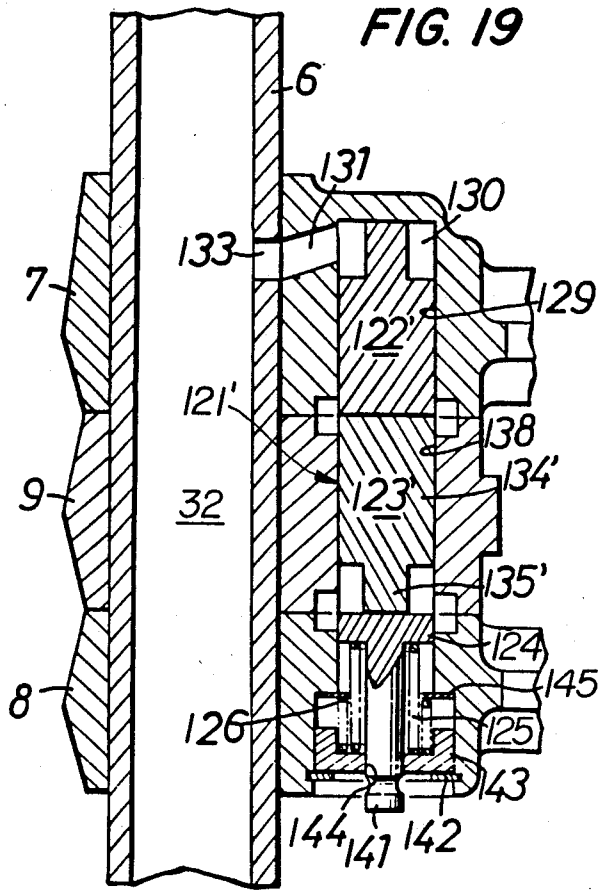

FIG. 19 shows another embodiment of the present invention. According to this embodiment, the first rocker arm 7, held in sliding contact with a low-speed cam 3 and engaging one of the intake valves 1*a*, and the second rocker arm 8, held in sliding contact with the cam having a circular raised portion 4 and engaging the other intake valve 1*b*, are disposed one on each side of the third rocker arm 9 that is held in sliding contact with a high-speed cam 5. A second coupling pin 123', slidably fitted in a guide hole 138 in the third rocker arm 9, has a larger-diameter portion 134' near a first coupling pin 122' and a smaller-diameter portion 135' near stopper 124, the smaller-diameter portion 135' being coaxially and integrally joined to the larger-diameter portion 134'. Therefore, when relatively low hydraulic pressure P1 is supplied to a hydraulic pressure chamber 130, the first and third rocker arms 7, 9 are interconnected by the first coupling pin 122', but the third and second rocker arms 9, 8 are not connected together. All of the rocker arms 7 through 9 are interconnected when relatively high hydraulic pressure P2 is supplied to the hydraulic pressure chamber 130.

More specifically, when the engine operates at a low speed, the intake valve 1*a* is opened and closed at the valve timing and lift according to the cam profile of the low-speed cam 3, and the intake valve 1*b* remains closed. During medium-speed operation of the engine, the intake valve 1*a* is opened and closed at the valve timing and lift according to the cam profile of the high-speed cam 5, and the intake valve 1*b* remains closed. During high-speed operation of the engine, the intake valves 1*a*, 1*b* are opened and closed at the valve timing and lift according to the cam profile of the high-speed cam 5.

As alternative forms of the embodiment of FIG. 19, rocker arms 7, 7 may be disposed on each side of the rocker arm 9 held in sliding contact with a high-speed cam 5, the rocker arms 7, 7 being held in sliding contact with respective low-speed cams 3 and engaging intake valves 1*a*, 1*b* as shown in FIG. 16. Alternatively, rocker arm 8, held in sliding contact with a raised portion 4 and engaging the intake valve 1*a*, and rocker arm 7, held in sliding contact with a low-speed cam 3 and engaging an intake valve 1*b*, may be disposed one on each side of a rocker arm 9 held in sliding contact with a high-speed cam 5 as shown in FIG. 17. As a further alternative of this embodiment, rocker arm 8, held in sliding contact with cam 4 having a raised circular portion and engaging an intake valve 1*a*, and rocker arm 9 held in sliding contact with a high-speed cam 5 and engaging an intake valve 1*b*, may be disposed one on each side of rocker arm 7 held in sliding contact with a low-speed cam 3 as shown in FIG. 18.

Figure 20:
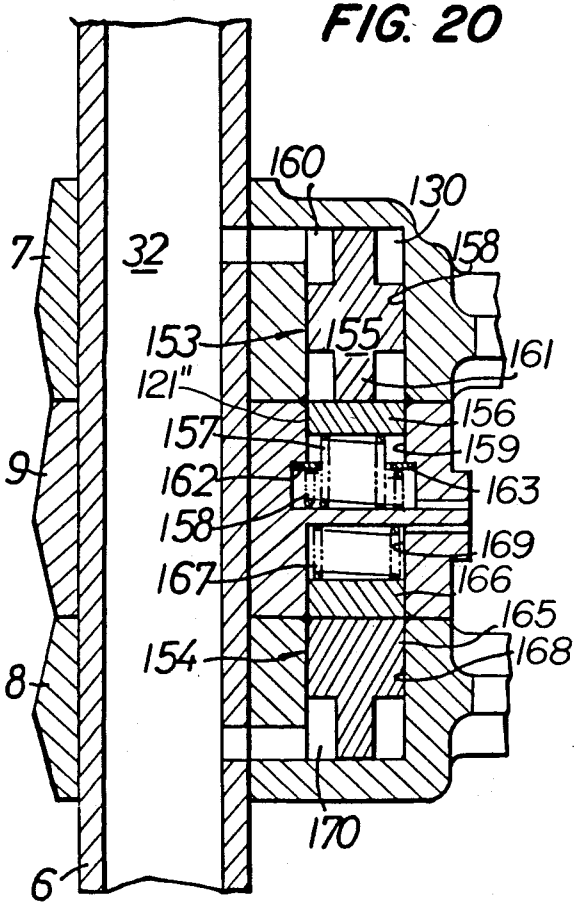
FIGS. 19, 20, 21 are sectional views similar to FIG. 4 illustrating further embodiments of the invention.

In the embodiment of FIG. 20, a selective coupling 153 is disposed between rocker arms 7, 9, and a selective coupling 154 is disposed between rocker arms 8, 9. The selective coupling 153 comprises a coupling pin 155 as a coupling member capable of interconnecting the rocker arms 7, 9, a stopper 156 for limiting movement of the coupling pin 155, and springs 157, 158. The rocker arms 7, 9 have coaxially aligned guide holes 158, 159. The coupling pin 155 is slidably fitted in the guide hole 158, and the stopper 156 is slidably fitted in the guide hole 159. The closed end of the guide hole 158 and the coupling pin 155 jointly define a hydraulic pressure chamber 160 therebetween. The coupling pin 155 includes a smaller-diameter portion 161 projecting coaxially toward the rocker arm 9. The coupling pin 155 can be slid in two different strokes for selectively interconnecting and disconnecting the rocker arms 7, 9.

The spring 157 is interposed between the stopper 156 and the closed end of the guide hole 159. The spring 158 is interposed between the closed end of the guide hole 159 and a seat member 163 engageable with the stopper 156 and a step 162 defined in the guide hole 159 and facing the closed end thereof. The spring 157 has a set load selected to be smaller than the set load of the spring 158. Therefore, the coupling pin 155 is slid selectively in two different strokes by selectively applying high and low hydraulic pressure to the hydraulic pressure chamber 160. Specifically, when the low hydraulic pressure is applied to the hydraulic pressure chamber 160, the coupling pin 155 is slid while compressing the spring 157 until the stopper 156 abuts against the seat member 163. Since only the smaller-diameter portion 161 of the coupling pin 155 projects into the guide hole 159 at this time, the rocker arms 7, 9 remain disconnected from each other. When the hydraulic pressure chamber 160 is supplied with high hydraulic pressure, the coupling pin 155 is slidably moved into the guide hole 159 while compressing the springs 157, 159, so that the rocker arms 7, 9 are interconnected for movement in unison.

The selective coupling 154 has a coupling pin 165 as a coupling member capable of interconnecting the rocker arms 8, 9, a stopper 166 for limiting movement of the coupling pin 165, and a spring 167. The rocker arms 8, 9 each have coaxially aligned guide holes 168, 169. The coupling pin 165 is slidably fitted in the guide hole 168, and the stopper 166 is slidably fitted in the guide hole 169. The closed end of the guide hole 168 and the coupling pin 165 jointly define a hydraulic pressure chamber 170 therebetween. The spring 167 has a set load selected to be equal to the set load of the spring 157, and is disposed between the closed end of the guide hole 169 and the stopper 166.

When the low hydraulic pressure is supplied to the hydraulic pressure chamber 170, the coupling pin 165 is moved, while compressing the spring 167 until it is slid into the guide hole 169, whereupon the rocker arms 8, 9 are coupled together. Therefore, when the low hydraulic pressure is supplied from the hydraulic pressure passage 32 to the hydraulic pressure chambers 160, 170, the rocker arms 8, 9 are interconnected and the rocker arms 7, 9 are disconnected. When the high hydraulic pressure is applied from the hydraulic pressure passage 2 to the hydraulic pressure chambers 160, 170, all of the rocker arms 7, 8, 9 are connected together.

Figure 21:
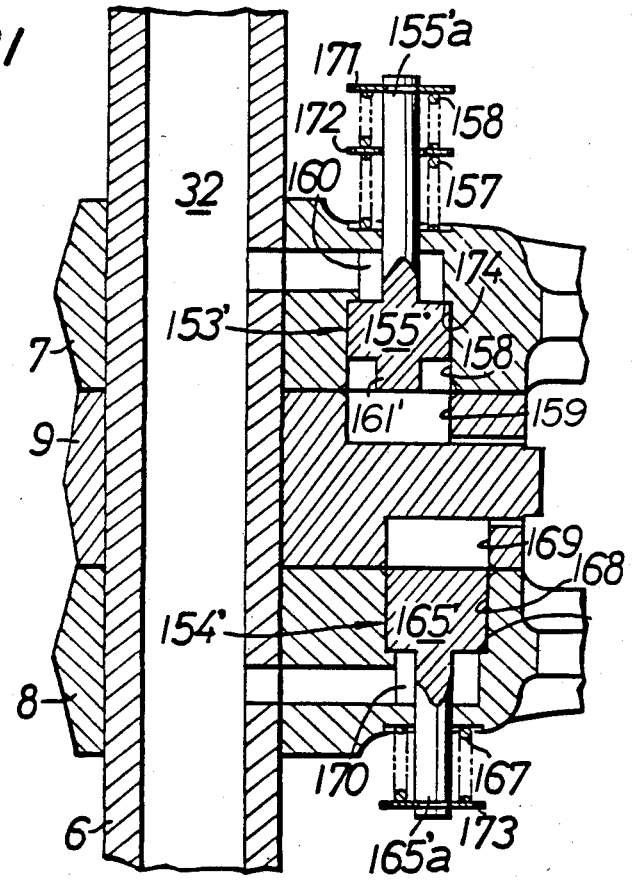

FIG. 21 shows yet another embodiment of the present invention in which a selective coupling 153' is disposed between the rocker arms 7, 9 and a selective coupling 154' is disposed between rocker arms 8, 9. The selective coupling 153' has a coupling pin 155' as a coupling member and springs 157, 158, and the selective coupling 154' has a coupling pin 165' as a coupling member and a spring 167.

The rocker arms 7, 9 have guide holes 158, 159 defined therein. The coupling pin 155' is slidably fitted in the guide hole 158 and the coupling pin 155' is slidable into the guide hole 159. The coupling pin 155' has a smaller-diameter portion 161' projecting coaxially from one side thereof near the rocker arm 9, and a shaft **155'*a* projecting coaxially remotely from the smaller-diameter portion 161'. The shaft 155'*a* movably projects outwardly through the closed end of the guide hole 158. The springs 157, 158 are disposed in series between the projecting end of the shaft 155'*a* and the rocker arm 7. More specifically, one end of the spring 158 engages a flange 171 fitted over the projecting end of the shaft 155'*a*, and one end of the spring 157 abuts against the rocker arm 7. The opposite ends of the springs 157, 158 are held against the opposite surfaces of a seat plate 172 movable with respect to the shaft 155'*a*. The guide hole 158 has a step 174 for engaging the coupling pin 155' so that, when the coupling pin 155' is retracted to its stroke end, the distal end of the smaller-diameter portion 161' is positioned between the rocker arms 7, 9**.

The rocker arms 8, 9 have coaxial guide holes 168, 169 which are defined respectively therein and displaced out of axial alignment with the guide holes 158, 159. The coupling pin 165' is slidably fitted in the guide hole 168 and slidable into the guide hole 169. The coupling pin 165' has a shaft **165'*a* projecting coaxially therefrom and movably extending through the closed end of the guide hole 168. The spring 167 is disposed between a flange 173 fitted over the distal end of the shaft 165'*a* and the rocker arm 8. A step 175 is defined in the guide hole 168 for limiting the rearward stroke of the coupling pin 165'**.

In this embodiment, the rocker arms 8, 9 are interconnected when the low hydraulic pressure is supplied to the hydraulic pressure chambers 160, 170, and all of the rocker arms 7, 8, 9 are coupled together when the high hydraulic pressure is applied to the hydraulic pressure chambers 160, 170. This embodiment is advantageous in that it does not require the stoppers, which are needed in the previous embodiments, resulting in a simpler construction. The device, furthermore, can easily be assembled.

Figure 22:
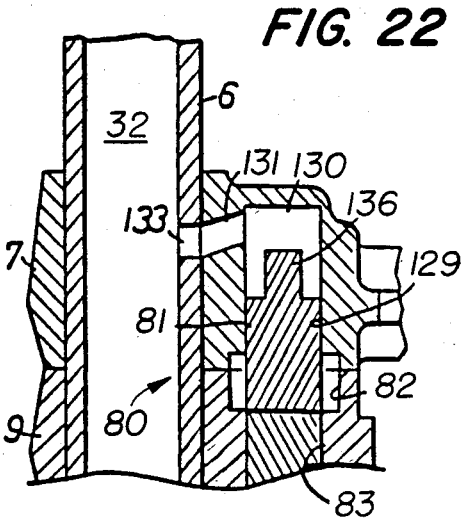

FIG. 22 illustrates a selective coupling 80 according to another embodiment of the present invention. The selective coupling 80 has a first coupling pin 81 slidably disposed in a hole 129 in the first rocker arm 7. The third rocker arm 9 mounted on the rocker shaft 6 adjacent to the first rocker arm 7 has a recess 82 defined in the side of the third rocker arm 9 which faces the first rocker arm 7. The recess 82 is of a size larger than that of the end of the first coupling pin 81. Therefore, when the end of the first coupling pin 81 is positioned in the recess 82, the first and third rocker arms 7, 9 are angularly movable with respect to each other. When the first coupling pin 81 is moved under hydraulic pressure into a hole 83 defined in the third rocker arm 9, the first and third rocker arms 7, 9 are interconnected and angularly movable in unison.

Figure 23:
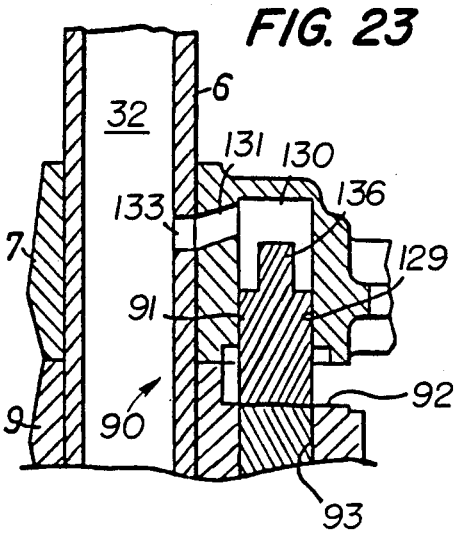
FIGS. 22 and 23 are views illustrating still further embodiments of the invention.

FIG. 23 illustrates a selective coupling 90 according to still another embodiment of the present invention. In the selective coupling 90, the third rocker arm 9 has a stepped wall surface 92 spaced from the opposite side wall of the first rocker arm 7 in which a first coupling pin 91 is slidably fitted. When the end of the first coupling pin 91 is positioned short of, or in alignment with, the stepped wall surface 92, the first and third rocker arms 7, 9 are relatively swingable. When the first coupling pin 91 is moved under hydraulic pressure into a hole 93 defined in the third rocker arm 9, the first and third rocker arms 7, 9 are swingable in unison.

Accordingly, the present invention provides valve operating apparatus in which through the utilization of return spring arrangements with the selective couplings wherein the spring force of the spring arrangements are different from one another with respect to the supply of different hydraulic pressures to the hydraulic pressure chambers of the couplings, a hydraulic pressure supply circuit of simple configuration can be employed to effect a multitude of valve operating modes. Therefore, valve control can be effected more accurately over a greater number of valve operating modes.

While the several embodiments of the present invention have been described with regard to the engine intake valves **1*a*, 1*b***, it should be understood that the invention is equally applicable to valve operating apparatus for driving exhaust valves. It will be further understood that various changes in the details, materials and arrangement of parts which have been described and illustrated herein in order to explain the nature of the invention can be made by those skilled in the art within the principal and scope of the invention as expressed in the appended claims.

We claim:

1. Valve operating apparatus for operating valve means in an internal combustion engine, comprising:

a camshaft rotatable in synchronism with the operation of said engine;

at least three adjacent rocker arms for operating said valve means;

a plurality of cams on said camshaft, each said cam having a cam surface engaging one of said rocker arms and a cam profile to impart a desired mode of operation to said valve means;

a selective coupling device for selectively connecting and disconnecting adjacent rocker arms, said coupling device including pistons carried in guide holes by respective of said rocker arms and extendable by hydraulic pressure into connection with the adjacent rocker arm, means for supplying hydraulic pressure to said pistons, and spring means for biasing said pistons against the force of said hydraulic pressure; and means for controlling the positional condition of said pistons with respect to said rocker arms, including:

a hydraulic circuit containing means for selectively supplying low pressure operating fluid or high pressure operating fluid to said coupling device; and said spring means being operative to provide one biasing spring force against said pistons upon the supply of low pressure operating fluid to said coupling device and a different biasing spring force against said pistons upon the supply of high pressure operating fluid thereto.

2. The valve operating apparatus according to claim 1 in which said coupling device includes a pair of pistons carried each by one of said rocker arms and each being extendable into the adjacent rocker arm, said spring means, in cooperation with said operating fluid, being operative to extend only one said piston into connected engagement with an adjacent rocker arm upon the supply of low pressure operating fluid to said coupling device and both said pistons into connected engagement with the respective adjacent rocker arms upon the supply of high pressure operating fluid thereto.

3. The valve operating apparatus according to claim 2 in which the movement of said pistons is directionally independent, and said spring means comprises separate springs having different spring loads operatively biasing each said piston.

4. The valve operating apparatus according to claim 2 in which the movement of said pistons is directionally dependent and said spring means comprises plural springs with the spring force of less than all springs operatively biasing said pistons upon the supply of low pressure operating fluid to said coupling device and the cumulative spring force of all springs operatively biasing said pistons upon the supply of high pressure fluid to said coupling device.

5. The valve operating apparatus according to claim 3 in which said operating fluid is supplied to both pistons simultaneously.

6. The valve operating apparatus according to claim 4 in which said pistons are mutually engaged for movement in unison and said operating fluid is supplied to one piston.

7. The valve operating apparatus according to claim 6 including means defining a clearance space between at least one piston and the guide hole into which it extends to render said at least one said piston ineffective to connect the adjacent rocker arm for movement in unison when said one piston is extended to a first extent into the adjacent rocker arm and means to render said one piston effective to connect the adjacent rocker arm for movement in unison when said one piston is extended to a second extent into said adjacent rocker arm.

8. The valve operating apparatus according to claim 7 in which said at least one piston comprises a piston body containing said clearance space which, when said at least one piston is extended to a first extent into the guide hole of the adjacent rocker arm, is ineffective to connect said adjacent rocker arms for movement in unison.

9. The valve operating apparatus according to claim 7 in which the guide hole of the adjacent rocker arm contains said clearance space which, when said at least one piston is extended to a first extent into said guide hole, is ineffective to connect said adjacent rocker arms for movement in unison.

10. The valve operating apparatus according to claim 1 including a pair of outer rocker arms and an intermediate rocker arm therebetween said selective coupling device comprising axially aligned guide holes in each said rocker arm, means forming pistons movable in said guide holes including hydraulically-operated pistons extendable from respective of said guide holes into the guide hole of the adjacent rocker arm to connect said rocker arms for movement in unison, at least one spring-operated piston movable in at least one of said guide holes, and said spring means being operative to provide a spring force operative to bias said at least one spring-operated piston against the adjacent hydraulically-operated piston to move the latter to a piston-disconnect position for independent movement of said adjacent rocker arms.

11. The valve operating apparatus according to claim 10 including a pair of hydraulically-operated pistons disposed in said intermediate rocker arm, each for extension into the adjacent outer rocker arms, spring-operated pistons in each of said outer rocker arms and a spring for biasing each said spring-operated piston, one of said springs having a biasing force to prevent movement of the adjacent hydraulically-operated piston upon supply of low pressure operating fluid thereto but ineffective to prevent movement of said hydraulically-operated piston upon supply of high pressure operating fluid thereto.

12. The valve operating apparatus according to claim 10 including hydraulically-operated pistons in each of said outer rocker arms and spring-biased pistons oppositely disposed in said intermediate rocker arm, a spring for biasing each said spring-operated piston, one of said springs having a biasing force to prevent movement of the adjacent hydraulically-operated piston upon supply of high pressure operating fluid thereto.

13. The valve operating apparatus according to claim 10 including a hydraulically-operated piston and a spring-operated piston oppositely disposed in said intermediate rocker arm, a spring-operated piston in one of said outer rocker arms engaging said intermediate rocker arm hydraulically-operated piston, and a hydraulically-operated piston in the other outer rocker arm engaging said intermediate rocker arm spring-biased piston, a spring for biasing each said spring-operated piston, one of said springs having a biasing force to prevent movement of the adjacent hydraulically-operated piston upon supply of low pressure operating fluid thereto but ineffective to prevent movement of said hydraulically-operated piston upon supply of high pressure operating fluid thereto.

14. The valve operating apparatus according to claim 10 including hydraulically-operated pistons formed integral with said spring-operated pistons disposed in each of said outer rocker arms, a spring for biasing each said spring-operated piston, one of said springs having a biasing force to prevent movement of the adjacent hydraulically-operated piston upon supply of low pressure operating fluid thereto but ineffective to prevent movement of said hydraulically-operated piston upon supply of high pressure operating fluid thereto.

15. The valve operating apparatus according to claim 1 including a pair of outer rocker arms and an intermediate rocker arm therebetween, said selective coupling device comprising axially aligned guide holes in each said rocker arm, a piston axially movable in each said guide hole, means for supplying operating fluid to said coupling device to move said pistons, said spring means engaging one of said pistons to bias said pistons to a rocker arm-disconnect position and including means for effectively moving said pistons one axial extent upon supply of low pressure operating fluid to said coupling device and to a further axial extent upon supply of high pressure operating fluid thereto, means defining a radial clearance space of limited axial extent between one said piston and the guide hole in the adjacent rocker arm, whereby said intermediate rocker arm and one of said outer rocker arms are connected for movement in unison upon supply of low pressure operating fluid to said coupling device and all of said rocker arms are connected for movement in unison upon supply of high pressure operating fluid to said coupling device.

16. The valve operating apparatus according to claim 15 in which said clearance space is formed by a reduced diameter portion on said one piston.

17. The valve operating apparatus according to claim 15 in which said clearance space is formed by an enlarged diameter portion in said guide hole in the adjacent rocker arm.

18. The valve operating apparatus according to claim 14 including means forming a radial clearance space of limited axial extent between one of said pistons and the guide hole in the adjacent rocker arm, and said spring biasing said one piston being effective for moving said one piston one axial extent upon supply of low pressure operating fluid to said coupling device and a further axial extent upon supply of high pressure operating fluid thereto, whereby said one piston is ineffective to connect the adjacent rocker arm for movement in unison at said one axial extent but effective to connect said adjacent rocker arm for movement in unison at said further axial extent.

19. The valve operating apparatus according to claim 18 in which said clearance space is formed by a reduced diameter portion on said one piston.

20. The valve operating apparatus according to claim 12 including means forming a radial clearance space of limited axial extent between one of said pistons and the guide hole in the adjacent rocker arm, and said spring biasing said one piston being effective for moving said one piston one axial extent upon supply of low pressure operating fluid to said coupling device and a further axial extent upon supply of high pressure operating fluid thereto, whereby said one piston is ineffective to connect the adjacent rocker arm for movement in unison at said one axial extent but effective to connect said adjacent rocker arm for movement in unison at said further axial extent.

21. The valve operating apparatus according to claim 20 in which said clearance space is formed by a reduced diameter portion on said one piston.

* * * * *